US006299458B1

(12) United States Patent
Yamagami et al.

(10) Patent No.: US 6,299,458 B1
(45) **Date of Patent: *Oct. 9, 2001**

(54) INTERMEDIATE ELECTRICAL CONNECTOR

(75) Inventors: Yoku Yamagami; Tsuyoshi Sakata; Tsutomu Matsuo; Takashi Nagawatari, all of Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/426,713

(22) Filed: Oct. 26, 1999

(30) Foreign Application Priority Data

Oct. 27, 1998 (JP) ..... 10-304641

(51) Int. Cl.[7] ..... H01R 12/00

(52) U.S. Cl. ..... 439/66; 439/91; 439/266; 439/330; 439/81; 439/591; 439/751; 439/862

(58) Field of Search ..... 439/66, 330, 525, 439/591, 71, 91, 266, 751, 733.1, 746, 862, 81, 82, 83, 79, 61, 67

(56) References Cited

U.S. PATENT DOCUMENTS

| | | | | |
|---|---|---|---|---|
| 4,161,346 | * | 7/1979 | Cherian et al. | 339/17 |
| 5,437,556 | * | 8/1995 | Bargain et al. | 439/66 |
| 5,957,703 | * | 9/1999 | Arai et al. | 439/66 |

* cited by examiner

*Primary Examiner*—Paula Bradley
*Assistant Examiner*—Truc Nguyen
(74) *Attorney, Agent, or Firm*—Kanesaka & Takeuchi

(57) ABSTRACT

A contact element (4) comprises a fixed section (5) inserted into the slot (2) along the first minor side of the slot, a flexible section (6) extending from the fixed section toward the second minor side of the slot in a plane and being flexible in the plane, and contact portions (7A, 7B) extending from the flexible section so as to project from the major faces of a housing (1). The fixed section, the flexible section, and the contact portions are in the plane parallel to the major faces of the slot. A conductive layer or sheet (3) is provided on the major sides of the slot. A sliding contact (8A, 8B) are provided near the contact portions are brought into sliding contact with the conductive layer or sheet.

4 Claims, 3 Drawing Sheets

INTERMEDIATE ELECTRICAL CONNECTOR

BACKGROUND OF THE INVENTION

1. Field of the Invention

The present invention relates to intermediate electrical connector for interconnecting two connectors or the like.

2. Description of the Related Art

U.S. Pat. No. 5,653,598 discloses an intermediate electrical connector of this type. The electrical connector comprises an insulating housing having a slot and a contact element provided in the slot. The contact element is made by stamping a metal sheet and formed in the V-shape such that the two free ends project from the upper and lower openings of the slot to form contact portions.

Mating connectors are provided on opposite faces of the housing and are pressed against the contact portions for electrical connection. The contact portions are offset slightly in the thicknesswise direction and, in use, brought into resilient contact with each other to form a shortcircuit.

However, the shortcircuit has a small sectional area so that the electrical resistance is large and, when the opposite ends are abutted to each other, the contact element becomes so rigid that it must be pressed against the connection portion with a large force and has a small amount of resilient deflection.

Contact arms are provided at the free ends and are brought into contact with each other. Since the shortcircuit is made by the contact arms, the sectional area of the shortcircuit is small, thereby providing a high electrical resistance.

After the two contact portions are contacted, the contact area shifts into the slot interior so that the difference in the thicknesswise direction is large. Consequently, the contact pressure becomes high, thereby increasing the rigidity. Usually, the connector has a large number of contact elements which are pressed simultaneously so that it must be pressed against the connection portion with a very large force.

Since the upper and lower springs are provided in a plane, there is provided a limited space to form a soft spring. Consequently, in order to provide an optimal pressure, the amount of resilient displacement must be small with a certain spring constant, resulting in the low contact reliability. That is, the amount of resilient displacement is so small and so different among the contact elements that the flexure or unevenness of mating connectors cannot be absorbed, resulting in the unstable contact and self inductance.

SUMMARY OF THE INVENTION

Accordingly, it is an object of the invention to provide an intermediate electrical connector having a contact element which has small electrical resistance and inductance and provides satisfactory amount of resilient deflection under a small force.

According to one aspect of the invention there is provided an intermediate electrical connector comprising a plate-like insulating housing having first and second major faces and at least one slot extending through the first and second major faces of the insulating housing and having firs and second major and minor sides; at least one contact element having a rigid fixed section for insertion in the slot along the first minor side of the slot, a flexible section extending from the fixed section toward the second minor side of the slot in a plane and being flexible in the plane, and a pair of contact portions extending from the flexible section so as to project from the first and second major faces, the fixed section, the flexible section, and the contact portions being in the plane which is parallel to the major faces of the slot; at least one conductive layer or sheet provided on at least one of the first and second major faces of the slot; and at least one boss for making sliding contact with the conductive layer or sheet.

In use, mating connectors or interfaces are provided on opposite major faces of the insulating housing such that the contact sections of the mating connectors are brought into resilient contact with the contact portions to interconnect both the connectors. The shortcircuit made by the contact element between the mating connectors has a large cross sectional area in the conductive layer or sheet.

According to another aspect of the invention, the contact element has a conductive plate in parallel to the major faces of the slot in place of the conductive layer or sheet. The conductive plate is bent at the fixed section of the contact element and formed integrally with the flexible section and the contact portions.

DESCRIPTION OF THE PREFERRED EMBODIMENT

Figure 2:
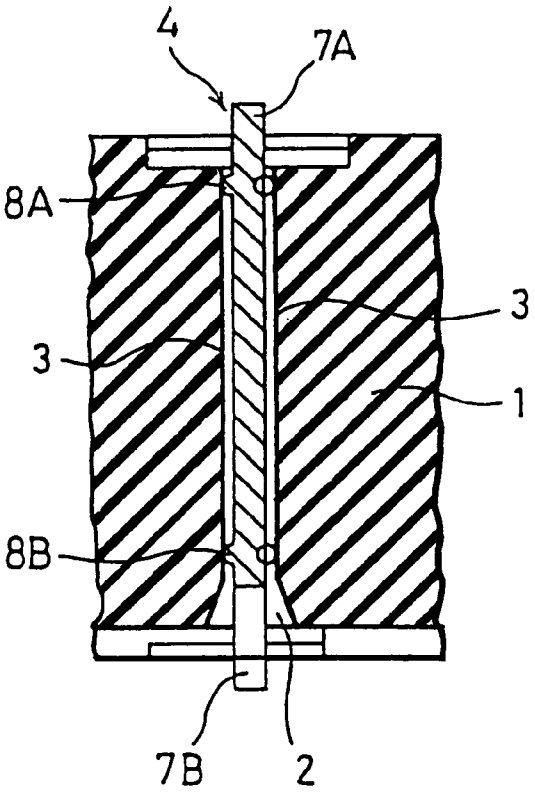
FIG. 2 is a sectional view taken along line 2—2 of FIG. 1.
Figure 1:
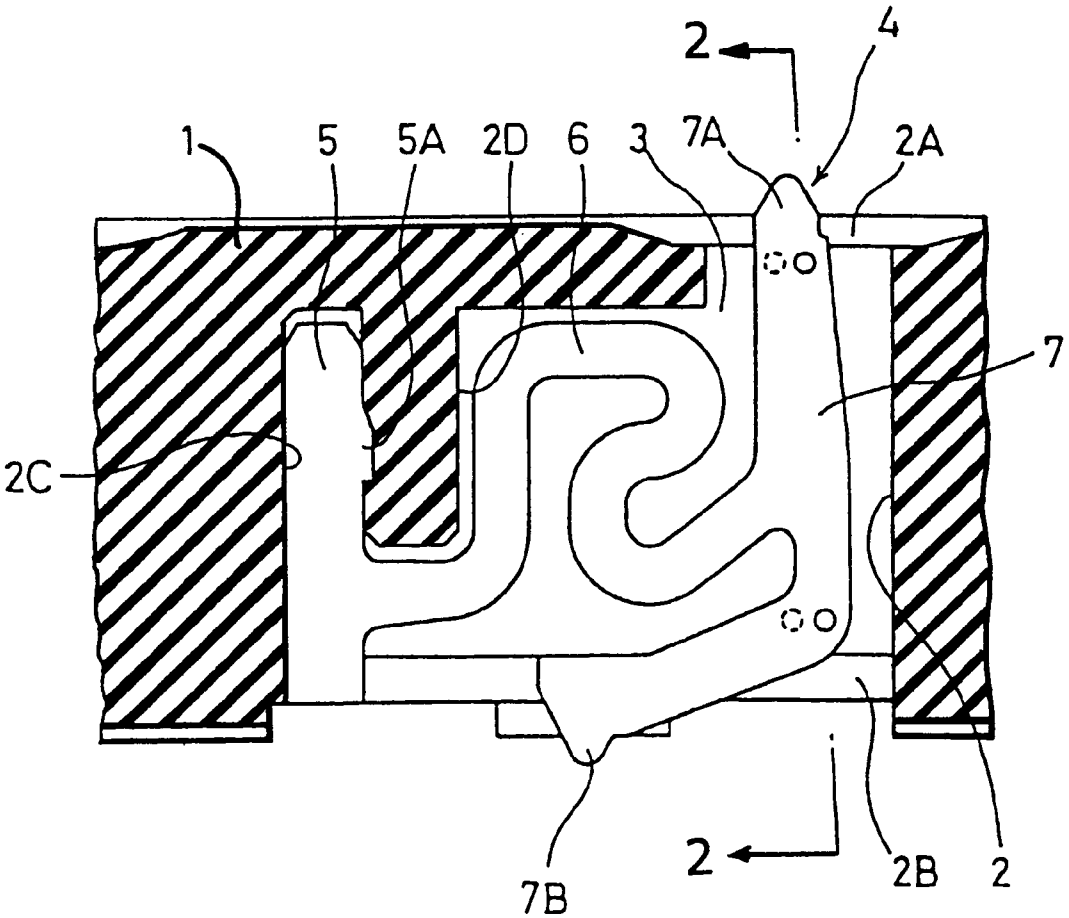
FIG. 1 is a sectional view of an intermediate electrical connector according to an embodiment of the invention.

In FIGS. 1–2, a plate-like housing 1 made from an insulative material has a plurality of slots 2 having upper and lower openings 2A and 2B in the thicknesswise direction. Each slot 2 has a narrow fixing section 2C and a broad accommodation section 2D, both of which communicate with each other in the lower portion of the housing 1 and lead to the opening 2B. The accommodation section 2D is stepped down to form the upper opening 2A. At least one conductive layer 3 is provided on an inside surface of the slot 2 by plating for example. A thin metal sheet may be substituted for the conductive layer 3. The plating is suitable for a complicated form of the slot but the conductive sheet may be made thick.

Figure 3:
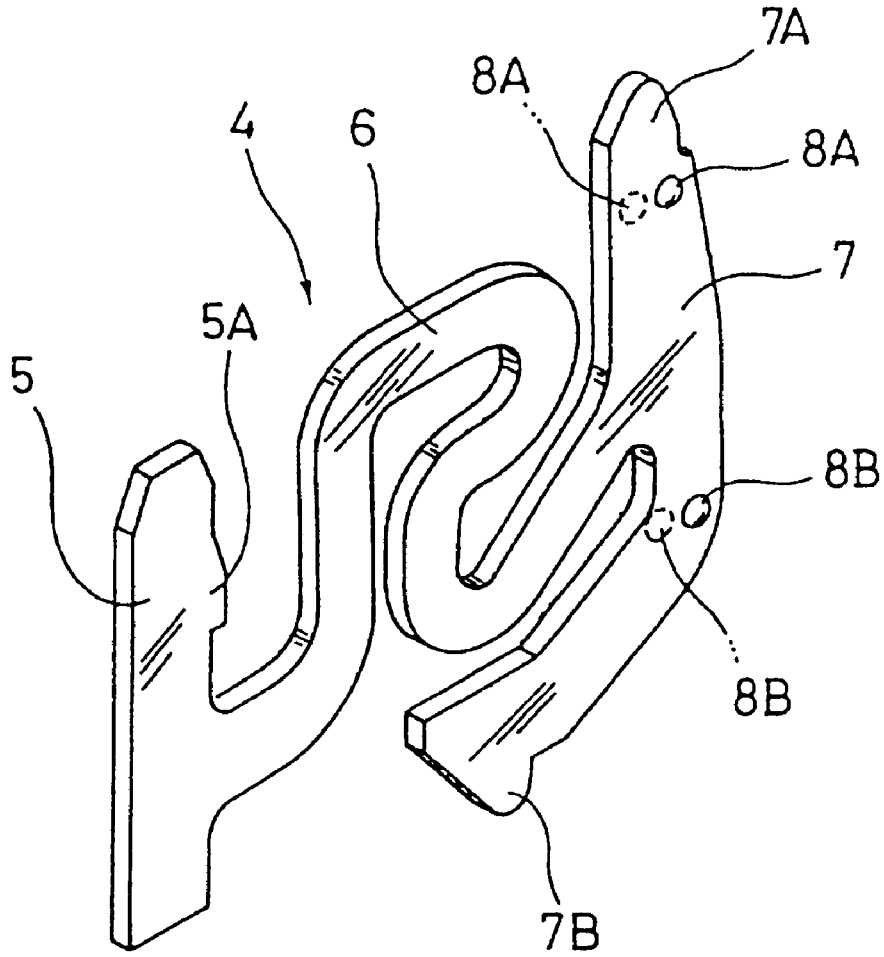
FIG. 3 is a perspective view of a contact element for the intermediate electrical connector.

As best shown in FIG. 3, the contact element 4 is made by stamping a metal sheet to provide a fixed section 5, a flexible section 6, and a movable section 7. The fixed section 5 has such a shape and dimension that it is press-fitted in the fixing section 2C of the slot 2 and a barb 5A to prevent separation of the contact element 4 from the slot 2. The flexible section 6 has an S-shape so that it is flexible in a plane of the contact element 4 in the accommodation section 2D of the slot 2. The movable section 7 extends from the flexible section 6 so as to provide upper and lower contact portions 7A and 7B. The contact portions 7A and 7B are rounded for contact with a mating connector or the like, such as a circuit board (not shown). As best shown in FIG. 1, the distance between the contact portions 7A and 7B is greater than the thickness of the housing 1 so that the contact portions 7A and 7B project from the upper and lower openings 2A and 2B. Sliding contacts or bosses 8A and 8B are provided on opposite faces of the movable section 7 near the contact portions 7A and 7B such that when the contact element 4 is inserted in the slot 2 of the housing 1, they are brought into contact with the conductive layer 3 in the slot 2 (FIG. 2).

A pair of mating connectors, circuit boards, or the like (not shown) are provided at predetermined positions on the upper and lower faces of the housing 1 of the intermediate electrical connector. When the mating connectors are held at the predetermined positions, the connection sections of the mating connectors are pressed against the contact portions 7A and 7B of the contact element 4. Since the contact portions 7A and 7B are offset in the plane, the contact pressures at the upper and lower contact portions 7A and 7B produce a bending moment about the joint between the movable section 7 and the flexible section 6, flexing the flexible section 6 in the plane. Consequently, the contact portions 7A and 7B are deflected resiliently into the interior of the slot 2. Since the flexible sections 6 are so long that the amount of resilient deflection is relatively large for the small pressure. Consequently, the contact conditions of the contact elements 4 with the mating connectors become even and stable.

The sliding contacts or bosses 8A and 8B of the movable section 7, which are normally in contact with the conductive layer 3 of the slit 2, are brought into sliding contact with the conductive layer 3 owing to the resilient displacement of the contact portions 7A and 7B. Consequently, the shortcircuit between the mating connectors is made from the contact portion 7A to the conductive layer 3 via the boss 8A and from the boss 8B to the contact portion 7B. That is, the path between the bosses 8A and 8B is the conductive layer 3 having a large area which has low electrical resistance and inductance. This area is a major portion of the movable section 7 so that the electrical resistance of the shortcircuit is reduced remarkably.

A conductive sheet may be provided in the slot in place of the plated conductive layer. In this case, the formation and insertion of the conductive sheet require considerable amounts of labor so that the form of the slot must be simple. The larger the thickness of the resulting conductive sheet, the larger the strength of the conductive sheet and the lower the electrical resistance and inductance of the shortcircuit.

In the embodiment of FIGS. 1–3, the conductive layer or sheet is a separate member from the contact element, but they are made integrally in one body, enabling to reduce the number of parts and eliminating the process step of plating the conductive layer or inserting the conductive sheet.

Figure 4:
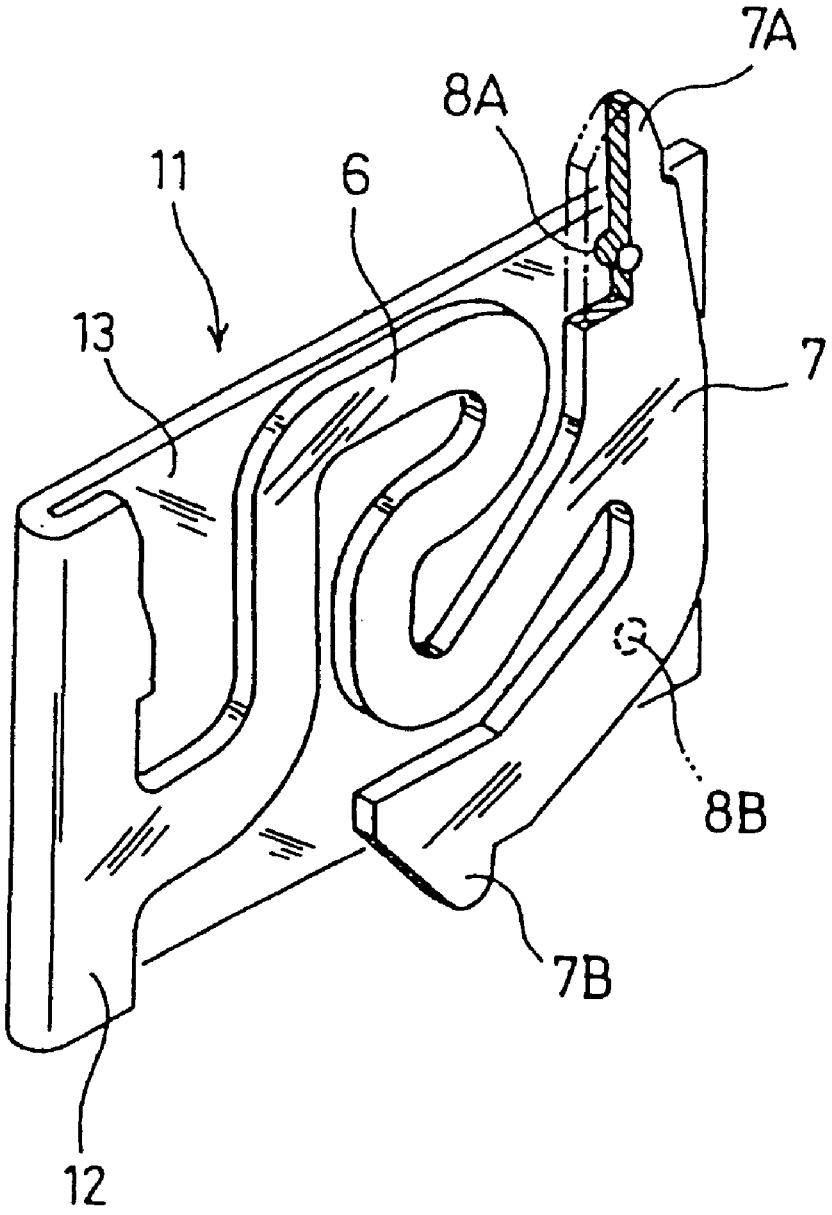
FIG. 4 is a perspective view of a contact element for the intermediate electrical connector according to another embodiment of the invention.

For example, in FIG. 4, a contact element 11 is bent at an edge of a conductive plate 13 and has a fixed section 12, a flexible section 6, and a movable section 7. The conductive plate 13 is sufficiently large to cover the flexible section 6 and most of the movable section 7. Similarly to the first embodiment, the movable section 7 has contact portions 7A and 7B and posses 8A and 8B of this embodiment. The bosses 8A and 8B, however, are in contact with the conductive plate 13.

As has been described above, according to the invention, a conductive layer or sheet is provided in the slot of a housing or a conductive plate is provided along with the contact element so that the shortcircuit is made via the conductive layer or sheet, or plate, thus minimizing the electrical resistance and inductance in the shortcircuit area. Consequently, the electrical resistance of the entire shortcircuit between the mating connectors is minimized. The flexible section is not blocked by the conductive layer or sheet from deforming, thus assuring large amounts of resilient deflection, which in turn assures even and stable contacts of the contact elements.

What is claimed is:

1. An intermediate electrical connector comprising:

a plate-like insulating housing having top and bottom faces and at least one slot extending through said top and bottom faces of said insulating housing and defined by first and second major and minor walls;

at least one contact element having a rigid fixed section for insertion in said slot along said first minor wall of said slot, a flexible section extending directly from said fixed section toward said second minor wall of said slot in a plane and being flexible in said plane, a rigid movable section extending directly from said flexible section in said plane substantially along said second minor wall of said slot and a pair of contact portions extending from both ends of said movable section and projecting from said top and bottom faces of said insulating housing; and at least one conductive layer or sheet provided on at least one of said first and second major walls of said slot, said fixed section, said flexible section, said movable section and said contact portions being in said plane which is parallel to said major walls of said slot; and said rigid movable section having means for making sliding contact with said conductive layer or sheet.

2. An intermediate electrical connector comprising:

a plate-like insulating housing having top and bottom faces and at least one slot extending through said top and bottom faces of said insulating housing and defined by first and second major and minor walls; and at least one contact element having a rigid fixed section for insertion in said slot along said first minor wall of said slot, a flexible section extending directly from said fixed section toward said second minor wall of said slot in a plane and being flexible in said plane, a rigid movable section extending directly from said flexible section in said plane substantially along said second minor wall of said slot and a pair of contact portions extending from both ends of said movable section and projecting from said top and bottom faces of said insulating housing, said fixed section, said flexible section, said movable section and said contact portions being in said plane which is parallel to said major walls of said slot;

said contact element having a conductive plate section extending directly from said fixed section toward said contact portions in parallel to said first and second major walls of said slot, and said rigid movable section having means for making sliding contact with said conductive plate.

3. An intermediate electrical connector according to claim 1, wherein said conductive layer or sheet extends over a substantially whole area of said major wall of said slot, thus obtaining a large sectional conductive area for short-circuit when said means makes sliding contact with said conductive layer or sheet.

4. An intermediate electrical connector according to claim 2, wherein said conductive plate section extends over a substantially whole area of a plane facing in parallel to said major wall of said slot, thus obtaining a large sectional conductive area for short-circuit when said means makes sliding contact with said conductive plate.

* * * * *